US008794028B2

(12) United States Patent
Petersen et al.

(10) Patent No.: US 8,794,028 B2
(45) Date of Patent: Aug. 5, 2014

(54) REFRIGERATION SYSTEM

(75) Inventors: Hans Kurt Petersen, Egtved (DK); Allan Juhl Moustgaard, Soenderborg (DK); Joergen Holst, Sydals (DK)

(73) Assignee: Danfoss A/S, Nordborg (DK)

( * ) Notice: Subject to any disclaimer, the term of this patent is extended or adjusted under 35 U.S.C. 154(b) by 1202 days.

(21) Appl. No.: 12/664,708

(22) PCT Filed: Jun. 17, 2008

(86) PCT No.: PCT/DK2008/000222

§ 371 (c)(1),
(2), (4) Date: Jun. 16, 2010

(87) PCT Pub. No.: WO2008/154922

PCT Pub. Date: Dec. 24, 2008

(65) Prior Publication Data

US 2010/0307190 A1 Dec. 9, 2010

(30) Foreign Application Priority Data

Jun. 19, 2007 (DE) ..... 10 2007 028 562

(51) Int. Cl.
*F25B 39/02* (2006.01)

(52) U.S. Cl.
USPC ..... 62/525; 62/524

(58) Field of Classification Search
USPC ..... 62/525, 524, 504, 527, 528, 522
See application file for complete search history.

(56) References Cited

U.S. PATENT DOCUMENTS

| | | | | | |
|---|---|---|---|---|---|
| 2,637,985 | A | | 5/1953 | Ray | |
| 2,960,073 | A | * | 11/1960 | Roxburgh | 137/596 |
| 3,095,889 | A | * | 7/1963 | Barroll et al. | 137/14 |
| 3,459,208 | A | * | 8/1969 | Clyde | 137/119.03 |
| 4,262,496 | A | * | 4/1981 | Bell, Jr. | 62/504 |
| 4,305,417 | A | * | 12/1981 | Bell, Jr. | 137/119.03 |
| 4,505,297 | A | * | 3/1985 | Leech et al. | 137/561 A |
| 4,787,213 | A | * | 11/1988 | Gras et al. | 62/212 |

(Continued)

FOREIGN PATENT DOCUMENTS

| | | |
|---|---|---|
| DE | 174075 | 7/1906 |
| DE | 195 47 744 A1 | 6/1997 |

(Continued)

OTHER PUBLICATIONS

International Search Report for PCT/DK2008/000222 dated Sep. 15, 2008.

*Primary Examiner* — Ljiljana Ciric
*Assistant Examiner* — Alexis Cox
(74) *Attorney, Agent, or Firm* — McCormick, Paulding & Huber LLP

(57) ABSTRACT

A refrigeration system including a refrigerant circuit with a plurality of evaporator paths and a distributor (5) for distributing refrigerants to the evaporator paths. The distributor including a controllable valve (14) for each evaporator path. The refrigeration system can be operated by using a distributor (5), which includes a housing (11) and a rotor rotatably mounted in the housing (11) and at least one radially oriented projection (15) on the circumference of the rotor, which interacts respectively with a valve element of a valve.

10 Claims, 4 Drawing Sheets

(56) References Cited

U.S. PATENT DOCUMENTS

| | | | | |
|---|---|---|---|---|
| 5,613,511 | A * | 3/1997 | Andersen et al. | 134/167 R |
| 5,832,744 | A | 11/1998 | Dorste et al. | |
| 6,370,908 | B1 | 4/2002 | James | |
| 8,191,384 | B2 * | 6/2012 | Funder-Kristensen et al. | 62/504 |
| 2006/0107689 | A1 * | 5/2006 | Nungesser et al. | 62/527 |
| 2006/0201197 | A1 * | 9/2006 | Kim | 62/504 |
| 2007/0289329 | A1 * | 12/2007 | Kearney et al. | 62/527 |
| 2010/0293978 | A1 * | 11/2010 | Thybo et al. | 62/222 |

FOREIGN PATENT DOCUMENTS

| | | | |
|---|---|---|---|
| JP | 50127231 | A | 10/1975 |
| JP | 56039676 | A | 4/1981 |
| JP | 56165167 | A | 12/1981 |
| JP | 2003004340 | A | 1/2003 |

* cited by examiner

REFRIGERATION SYSTEM

CROSS REFERENCE TO RELATED APPLICATIONS

This application is entitled to the benefit of and incorporates by reference essential subject matter disclosed in International Patent Application No. PCT/DK2008/000222 filed on Jun. 17, 2008 and German Patent Application No. 10 2007 028 562.2 filed Jun. 19, 2007.

FIELD OF THE INVENTION

The invention concerns a refrigeration system with a refrigerant circuit, comprising several evaporator paths and a distributor causing a distribution of refrigerant to the evaporator paths, said distributor having a controllable valve for each evaporator path.

BACKGROUND OF THE INVENTION

Such a refrigeration system is known from DE 195 47 744 A1. The known refrigeration system comprises one single compressor and one single condenser, but two evaporators, which are made separately from one another. The refrigerant flow delivered by the compressor is divided into two partial flows after the condenser and before the expansion valves by means of a 3/2-way valve, whose position is controlled by a control unit. This embodiment, however, only permits dividing the refrigerant flow into two evaporator paths.

To permit the supply of several evaporator paths, U.S. Pat. No. 5,832,744 discloses a refrigeration system, in which the distributor comprises a valve between one refrigerant inlet and several refrigerant outlets, said valve being connected in series to a rotating turbine blade. The turbine blade is provided to ensure that the refrigerant is distributed evenly to all outlets of the distributor and thus also evenly to all evaporators.

In theory, such a distributor ensures an even distribution of the refrigerant to the individual evaporators. However, already small differences in the dimensions, which could, for example, occur during manufacturing, cause an uneven distribution of the refrigerant to the individual evaporators. Further, with such distributors, it is necessary that basically the individual distributors have the same thermal load and also the same flow resistance. If this is not the case, it may happen that one evaporator receives too much refrigerant, so that the refrigerant is not completely evaporated when it has passed the evaporator. Another evaporator, which is connected to the same distributor can receive too little refrigerant, so that the evaporator cannot deliver the desired refrigeration performance. The oversupply or the undersupply of the evaporator can in particular cause problems, if temperature sensors, which are located at the evaporators or in other positions in the refrigeration system, are controlling an expansion valve. Under unfavourable circumstances, the expansion valve will be caused to vibrate naturally, which further deteriorates the capacity and the efficiency of the refrigeration system.

SUMMARY OF THE INVENTION

The invention is based on the task of achieving a desired operation of the refrigeration system with simple means.

With a refrigeration system as mentioned in the introduction, this task is solved in that the distributor comprises a housing and a rotor rotatably supported in the housing, the circumference of the rotor having at least one radially directed projection, each interacting with one valve element of a valve.

In the following, the term "refrigeration system" is to be understood in a broad sense. It particularly comprises refrigeration systems, freezing systems, air-conditioning systems and heat pumps. The term "refrigeration system" has merely been chosen for reasons of simplicity. The evaporator paths can be arranged in different evaporators. For reasons of simplicity, the invention is explained in connection with several evaporators. However, the invention can also be used, if one evaporator has several evaporator paths, which can be controlled individually or in groups.

Thus, for each evaporator path the evaporator comprises a controllable valve that can be controlled by the radially directed projection of the rotor. Thus, it is possible to control the individual evaporator paths individually, that is, it is possible to supply each evaporator with the amount of refrigerant that is required. It no longer has to be considered that all evaporators have the same flow resistance. It is also of inferior importance, if the evaporators have to provide different refrigeration performances. An evaporator, from which a large refrigeration performance is required, receives correspondingly more refrigerant than an evaporator, which must supply less refrigeration. It must merely be ensured that during one rotation of the rotor the valve of the evaporator, which requires more refrigerant, remains open for a longer period than the valve of an evaporator that needs less refrigerant. As the rotor has a radially directed projection, it is sufficient if the rotor is supported to be sufficiently stable in the radial direction. All other supports can then be made in a relatively simple manner, as here the acting forces are small. It is also relatively easy to manufacture a radially directed projection, for example in the form of a cam. More than two evaporator paths can be provided with little effort.

Preferably, the valve elements are radially movable in relation to the rotation axis of the rotor. Thus, the effect of the radially directed projection can immediately be converted to a movement of the valve element. This simplifies the design of the distributor. When the valve elements are radially movable, more room is available for arranging the valve elements.

Preferably, each valve element has a return spring that presses the valve element in the direction of a valve seat. Without the influence of the cam or the radial projection on the rotor, the valve thus remains closed. Not until the projection acts upon the valve element, the valve element is lifted from the valve seat against the force of the return spring, thus opening the valve.

Preferably, the return spring is supported in a cage insert that is arranged in an outlet opening of the housing. On the one side, the cage insert is able to support the return spring so that it can act upon the valve element with the required closing force. On the other side, the cage insert also comprises one or more sufficiently large passage openings, so that the refrigerant flowing through a gap between the valve element and the valve seat can also flow through the cage insert into the corresponding outlet of the distributor.

Preferably, the cage insert has a guide opening for the valve element, in which a shaft of the valve element is guided. Thus, the cage insert does not only support the return spring, but also guides the valve element linearly, so that the valve element cannot, or can only to a permitted extent, tilt in relation to the valve seat. Thus, it is ensured that the valve can close tightly.

Preferably, the cage insert is arranged in the outlet opening by means of press fit. This permits a relatively simple manufacturing. The preassembled cage insert with return spring and valve element is simply pressed into the outlet opening of the housing. The frictional forces thus occurring will be sufficient to hold the cage insert in the housing. The forces acting upon the cage insert are relatively small anyway. When the valve element is open, they are made up of the force of the return spring and the pressure with which the refrigerant acts upon the valve element.

Preferably, a tappet is arranged between the rotor and each valve element. The tappet forms a transfer element between the rotor and the valve element. This makes it possible with a small rotor also to activate valves, when they are arranged on a larger radius. This gives the opportunity of providing a sufficient number of valves. Further, a larger design freedom is achieved.

It is preferred that the tappet has a length, which is smaller than a distance between the valve element bearing on the valve seat and the rotor outside the projection. Thus, with closed valve a play exists between the tappet and the rotor. Thus, it can be ensured that at any rate the valve will remain closed, when the tappet is not acted upon by the radial projection of the rotor. This play can be dimensioned so that in the total temperature area that is permitted for the distributor, it is ensured that the valves close safely.

Preferably, in a chamber that connects a distributor inlet to the valves, the housing has a circumferential projection through which the tappet is guided. In the circumferential direction the projection can also be interrupted, as long as it is ensured that for each valve a bore or a passage is available, through which the tappet is guided. Through the chamber the distribution of refrigerant to the individual valves is effected.

In an alternative or additional embodiment it may be provided that the tappet is held in a tappet locking ring. The tappet locking ring is inserted in the housing. When it is used together with the circumferential projection, it is ensured that the tappet is supported at two positions having a distance in the movement direction. Thus, it can also be ensured over time that the tappet and the valve elements always maintain a predetermined alignment to one another.

Preferably, the ends of the tappets facing the individual valve element have a diameter reduction. Thus, over the largest part of its length the tappet can be provided with a sufficiently large diameter, so that it can adopt the pressure forces which are transferred by the projection of the rotor to the individual valve element. When its end tapers, then it is able to penetrate so far through the opening on whose outside the valve seat is formed. Thus, it is possible to open the valves sufficiently to keep the flow resistance for the refrigerant small.

Preferably, each valve element is made with a cone shape. Thus, a sealing between the valve seat and the valve element can easily be achieved. Further, the valve element can be led somewhat through the opening at whose outside the valve seat is formed, so that it can easily be reached by the tappet.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figure 1:
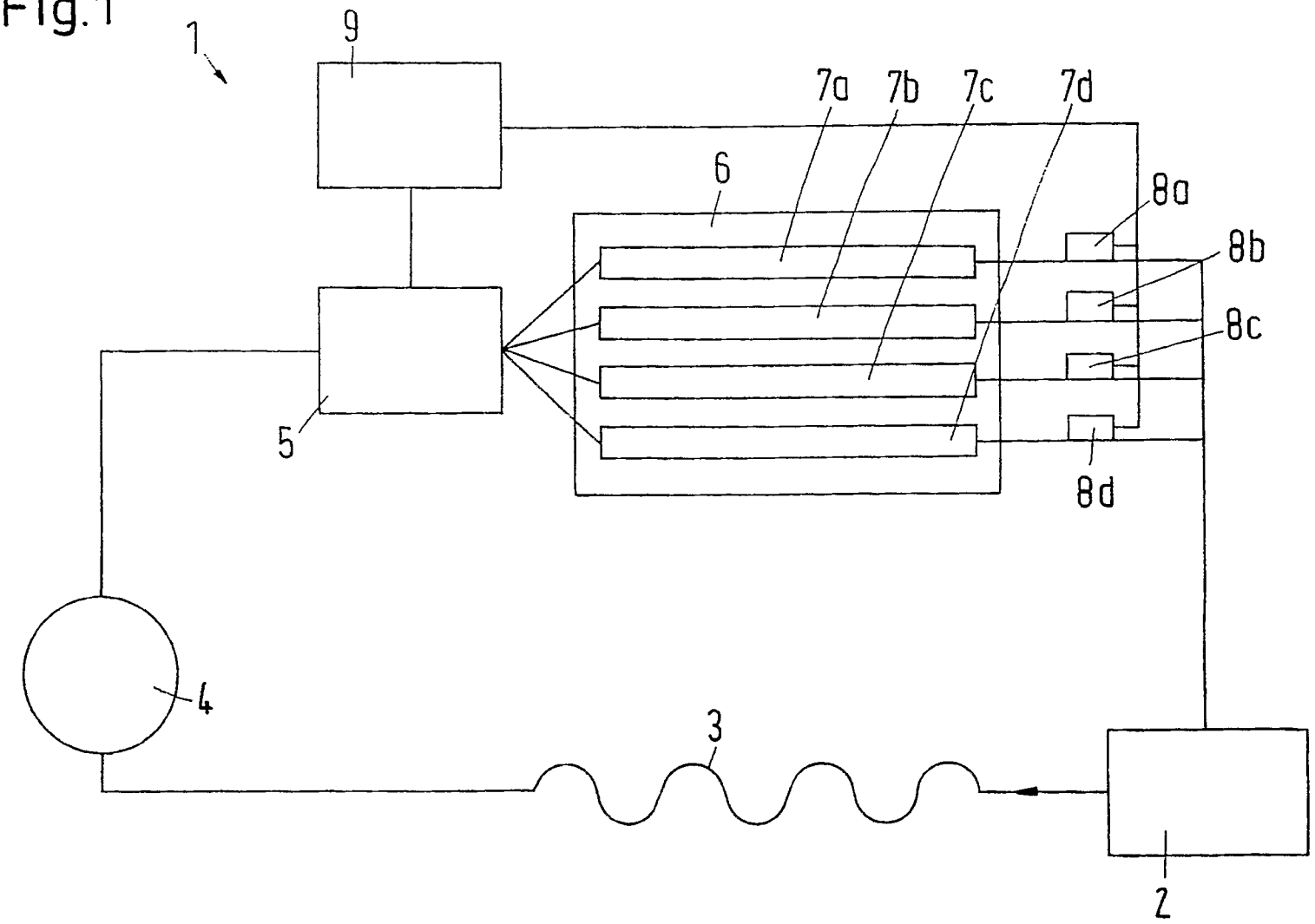
FIG. 1 is a schematic view of a refrigeration system with several evaporators.

FIG. 1 is a schematic view of a refrigeration system 1, in which a compressor 2, a condenser 3, a collector 4, a distributor 5 and an evaporation arrangement 6 with several evaporators 7*a*-7*d* arranged in parallel are joined to a circuit. The evaporator arrangement 6 can also comprise one single evaporator with several evaporation paths which are controlled individually or in groups. It is also possible to provide the evaporator arrangement 6 with several evaporators, of which at least one has several evaporator paths.

In a manner known per se, liquid refrigerant evaporates in the evaporators 7*a*-7*d*, is compressed by the compressor 2, liquefied in the condenser 3 and collected in the collector 4. The distributor 5 is provided to distribute the liquid refrigerant to the individual evaporators 7*a*-7*d*.

A temperature sensor 8*a*-8*d* is arranged at the outlet of each evaporator 7*a*-7*d*. The temperature sensor 8*a*-8*d* determines the temperature of the refrigerant leaving the evaporator 7*a*-7*d*. This temperature information is passed on to a control unit 9 that controls the distributor 5 in dependence of the temperature signals of the temperature sensors 8*a*-8*d*.

The FIGS. 2 to 7 now show the distributor 5 in a partly schematic view. The distributor 5 comprises a drive motor 10, for example in the form of a step motor. The drive motor 10 is fitted on a housing 11 that comprises an inlet that cannot be seen in FIG. 2 and several outlets 12. The control unit 9 can be integrated in the motor 10. However, it is also possible to arrange the control unit 9 separately from the motor 10 and merely supply the motor 10 with signals from the control unit 9.

Figure 3:
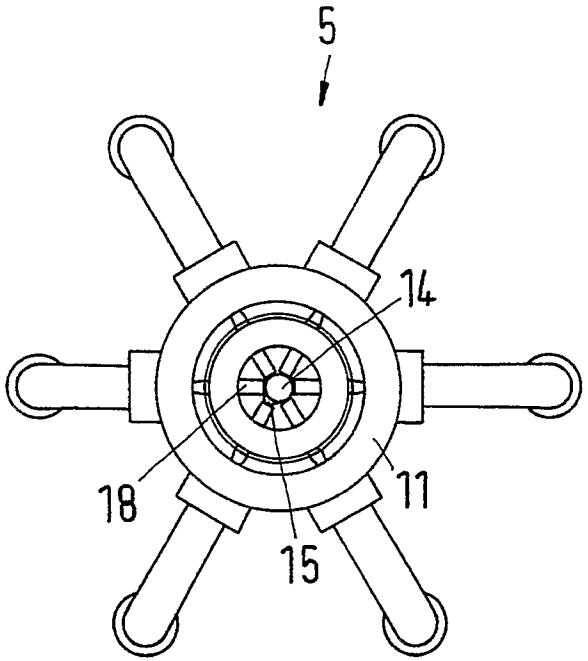
FIG. 3 is a top view of the distributor without motor.
Figure 2:
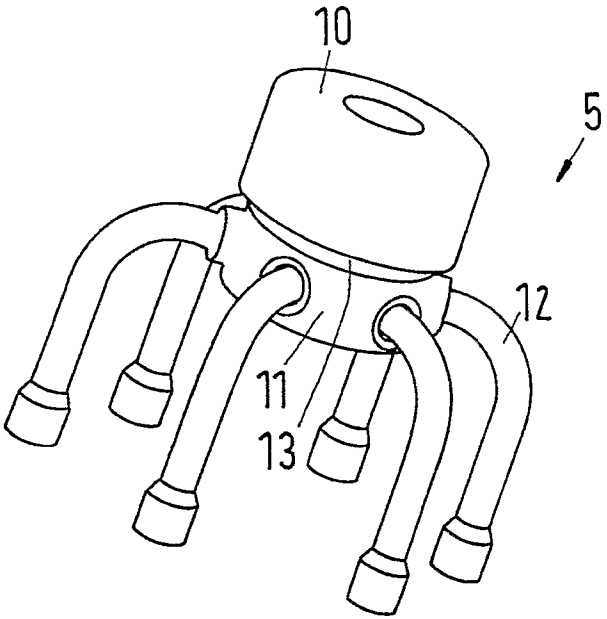
FIG. 2 is a perspective top view of a distributor.
Figure 4:
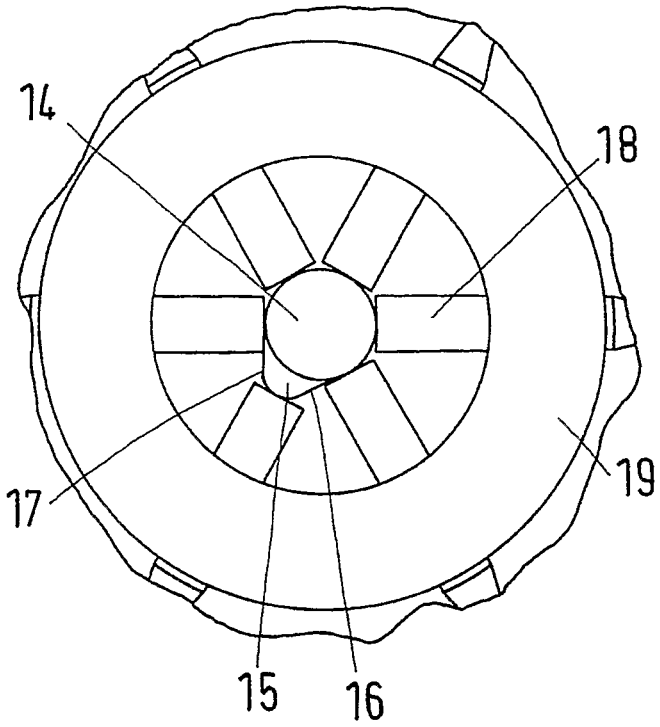
FIG. 4 is an enlarged view of the rotor with projection.
Figure 6:
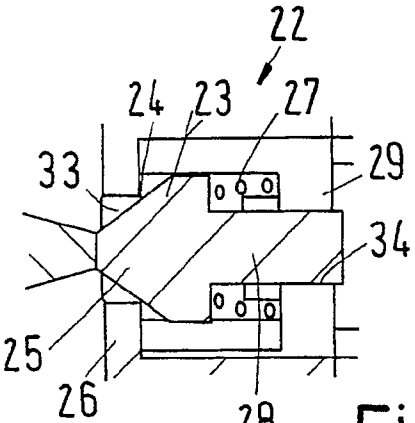
FIG. 6 is an enlarged section of FIG. 5.
Figure 7:
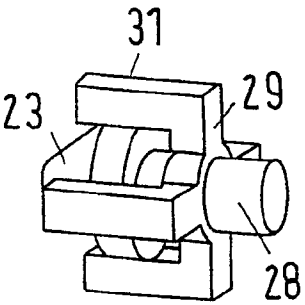
FIG. 7 is a perspective view of a valve element in a cage insert.
Figure 5:
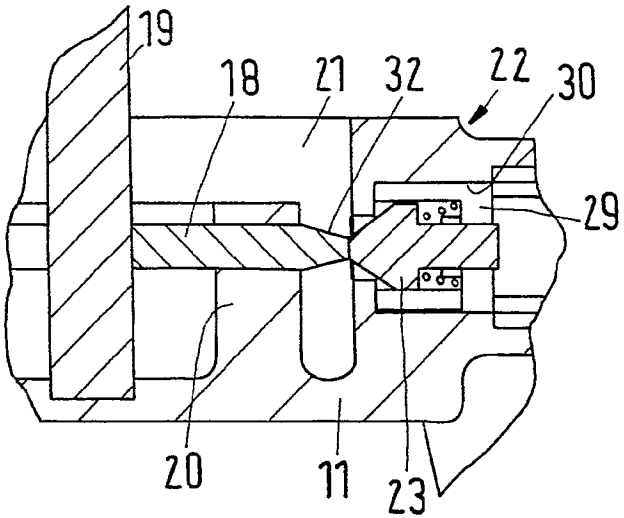
FIG. 5 is a sectional view of a valve.

FIG. 3 shows a top view of the distributor 5, the motor 10 having been removed, so that the inside of the distributor can be seen. As can be seen from FIG. 2, the motor 10 at the same time serves as cover for the housing. Between the motor 10 and the housing 11*a* sealing 13 is arranged, which prevents refrigerant from escaping from the housing 11.

The motor 10 drives a rotor 14, which is located in the housing 11. The rotor 14 has a radial projection 15, which has the shape of a cam with two bevelled sides 16, 17. When the rotor 14 rotates, the projection 15 acts upon a tappet 18, steering it radially outwards. The tappets 18 are held in a tappet locking ring 19. As appears from FIG. 5, the housing 11 comprises a projection 20 that projects into a distributor chamber 21. The tappets 18 are held once again in the projection 20.

The distributor chamber 21 connects the inlet to the valves 22, of which one is provided for each outlet 12. With one projection 15 on the rotor 14, one of the six valves 22 can be opened. The opening duration determines the amount of refrigerant that can flow off through the corresponding valve and thus through the corresponding outlet 12.

All valves 22 have the same design. Each valve 22 comprises a valve element 23 that interacts with a valve seat 24. The valve element 23 has a cone-shaped head 25 that is led through a housing wall 26, on whose radial outside the valve seat 24 is arranged.

The valve element 23 with its head 25 is pressed in the direction of the valve seat 24 by the force of a return spring 27. The return spring 27 engages the radial outside of the head 25. From here also a shaft 28 of the valve element 23 extends radially outwards. The shaft has a smaller diameter than the head 25, so that the return spring 27 has a sufficient bearing surface.

The other end of the return spring 27 is supported on a cage insert 29 that is pressed into an outlet opening 30. Thus, the cage insert 29 is fitted in the housing 11 by means of a press fit. As can be seen from FIG. 7, the cage insert 29 has several legs 31, with which it is held in the housing 11. Between them there are spaces through which refrigerant can flow into the corresponding outlet 12 when the valve 22 is open, that is, the valve element 23 is lifted from the valve seat 24.

The cage insert 29 comprises a guide opening 34 for guiding the shaft 28 of the valve element 23 so that the valve element 23 is sufficiently protected against a tilting. Thus, an edging of the valve element 23 in relation to the valve seat 24 is prevented, if it exceeds a predetermined measure.

The tappets 18 are shorter than a distance between the valve element 23 and the rotor 14 in the area outside the radial projection 15. This results in a certain play between the rotor 14 and the tappet 18, which interacts with a closed valve, or between the tappet 18 and the valve element 23. Thus, it can easily be ensured that the valve 22 is closed, if the projection 15 at the rotor 14 is not exactly meant to open that corresponding valve 22.

The end of the tappet 18 interacting with the valve element 23 comprises a diameter reduction 32. Thus, on the one side it can be ensured that the tappet 18 has a sufficient cross-section to adopt the pressure forces exerted by the projection 15 without a deformation. On the other side, the area in which the tappet 18 interacts with the valve element 23 is thin enough to pass through the opening 33 in the wall 26 of the housing at whose radial outside the valve seat 24 is arranged. Thus, it can be ensured that, when the tappet 18 with its diameter reduction 32 extends into the opening 33, a sufficient flow cross-section for the refrigerant through the valve 22 in question is provided.

While the present invention has been illustrated and described with respect to a particular embodiment thereof, it should be appreciated by those of ordinary skill in the art that various modifications to this invention may be made without departing from the spirit and scope of the present.

What is claimed is:

1. A refrigeration system with a refrigerant circuit, comprising:

a plurality of evaporator paths; and a distributor configured to distribute a refrigerant to the plurality of evaporator paths, said distributor comprising a plurality of controllable valves, each of the plurality of controllable valves corresponding to one of the plurality of evaporator paths;

wherein the distributor comprises:

a housing;

a motor;

a rotor rotatably supported in the housing and rotatably driven in the housing by said motor, the rotor having a radially projecting cam; and a plurality of tappets, each of the plurality of tappets being disposed between the rotor and a corresponding one of the plurality of controllable valves;

wherein rotation of the rotor causes the radially projecting cam to alternately move the plurality of tappets and alternately activate the plurality of controllable valves.

2. The refrigeration system according to claim 1, wherein each of the plurality of tappets has a length, which is smaller than a distance between a valve element of one of the plurality of controllable valves and a portion of the rotor not including the radially projecting cam when the valve element is in contact with the valve seat.

3. The refrigeration system according to claim 1, wherein in a chamber that connects a distributor inlet to the plurality of controllable valves, the housing has a circumferential projection through which the plurality of tappets are guided.

4. The refrigeration system according to claim 1, wherein the plurality of tappets are held in a tappet locking ring.

5. The refrigeration system according to claim 1, wherein an end of each of the plurality of tappets facing a valve element of each of the plurality of controllable valves has a diameter reduction.

6. The refrigeration system according to claim 1, wherein each of the plurality of controllable valves comprises a valve element having conical shape.

7. The refrigeration system according to claim 1, wherein each of the plurality of controllable valves comprises a valve element that is radially movable in relation to the rotation axis of the rotor.

8. The refrigeration system according to claim 7, wherein the valve element of each of the plurality of controllable valves has a return spring that presses the valve element toward a valve seat.

9. The refrigeration system according to claim 8, wherein the return spring is supported in a cage insert that is arranged in an outlet opening of the housing.

10. The refrigeration system according to claim 9, wherein the cage insert has a plurality of guide openings, each of the plurality of guide openings being configured to guide a shaft of the valve element of each of the plurality of controllable valves.

* * * * *